United States Patent [19]

Ochs

[11] 4,392,580

[45] Jul. 12, 1983

[54] CLOSURE CAP

[75] Inventor: Charles S. Ochs, Lancaster, Ohio

[73] Assignee: Anchor Hocking Corporation, Lancaster, Ohio

[21] Appl. No.: 285,610

[22] Filed: Jul. 21, 1981

[51] Int. Cl.[3] ..... B65D 41/04

[52] U.S. Cl. ..... 215/332; 215/333; 215/353

[58] Field of Search ..... 215/333, 332, 353

[56] References Cited

U.S. PATENT DOCUMENTS

| | | | |
|---|---|---|---|
| 1,667,003 | 4/1928 | Hardiman | 215/333 |
| 3,323,672 | 6/1967 | Acton | 215/333 |
| 3,469,727 | 9/1969 | Acton | 215/333 X |
| 3,516,565 | 6/1970 | Hatkevich | 215/333 |

*Primary Examiner*—Donald F. Norton

*Attorney, Agent, or Firm*—Holland, Armstrong, Wilkie & Previto

[57] ABSTRACT

A metal closure cap is described for sealing containers. It is of the lug type having a metal shell with a flowed-in gasket. The cap differs from prior twist caps of this general type by having a tapered corner between the cap top and the cap skirt. This corner design permits a reduced amount of metal to be used and further provides a more rigid closure corner permitting the use of lighter-weight metal. Improved methods of forming the cap shell, including the corner portion are also described.

14 Claims, 22 Drawing Figures

Fig. 10.
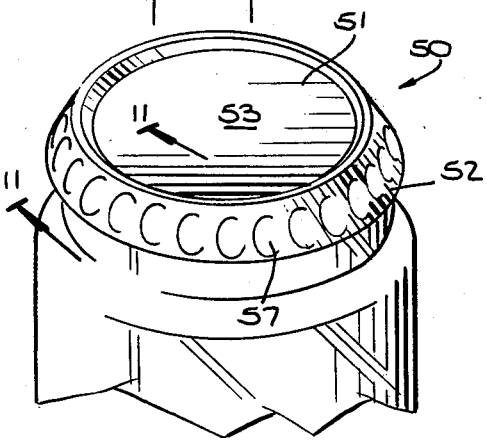
Fig. 11.
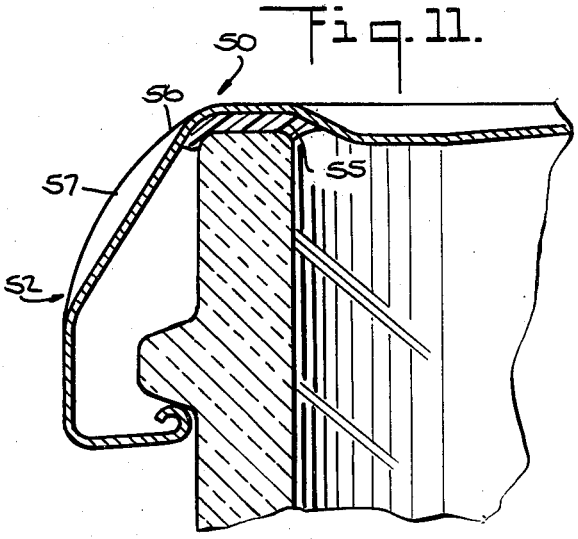
Fig. 12.
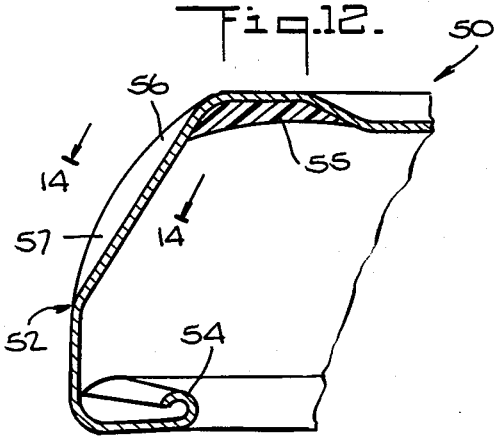
Fig. 13.
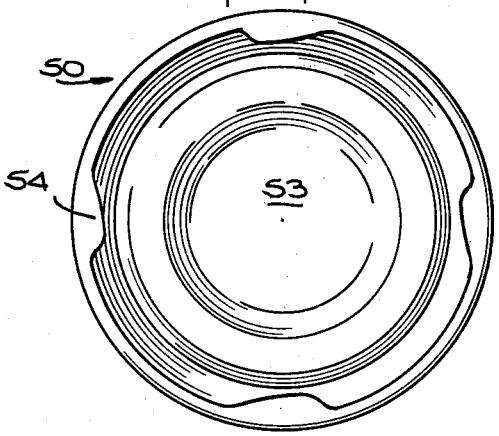
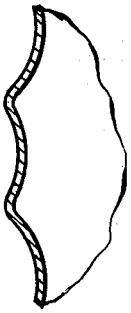
Fig. 14.
Fig. 15.
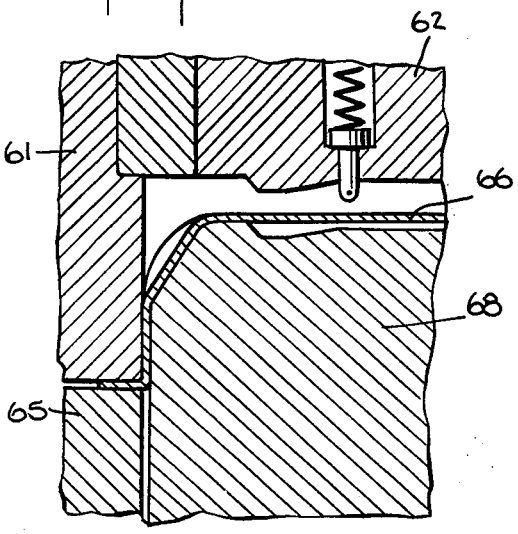
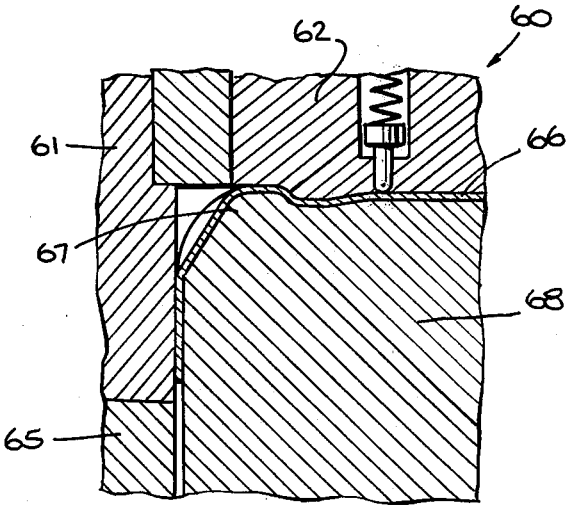
Fig. 16.

CLOSURE CAP

BACKGROUND OF THE INVENTION

This invention relates to twist closure caps for bottles and other containers and to a closure wherein a cap of a given size is made using less metal and gasket material, as well as using thinner metal plate. More particularly, the application relates to an improved cap shell shape, including a flared or tapered cap corner where the corner design provides a stiffer cap shell and a reduced cap blank size resulting in both metal and gasket material savings. Improved cap shell forming operations are also described in which the new cap corner shape is formed without distorting the finished cap shell.

A substantial number of glass and other containers are presently sealed with closure caps known as twist caps. These caps are characterized by a shaped metal cap shell with container engaging lugs formed on the lower edge of cap skirt. Additionally, each closure has a flowed-in plastisol gasket generally positioned between the cap corner and a stacking panel on the cap top. The most widely used caps of this type are further characterized by having a square or sharp crown corners so that generally flat covers are terminated in a right-angled depending straight skirt. By way of contrast, the cap of this invention has a shaped, or tapered, corner between the cap cover and the lower portion of the cap skirt. This corner shaping, as described more fully below, provides for the several advantages already noted, including the reduced use of metal and plastic materials.

Accordingly, an object of the present invention is to provide an improved closure cap.

Another object of the present invention is to provide a twist or screw cap utilizing lesser amounts of metal plate and gasket materials.

Another object of the present invention is to provide an improved method of manufacturing the improved closure cap.

Another object of the present invention is to provide an attractive and rigid twist cap manufactured of relatively light weight metal plate.

Other and further objects of the present invention will become apparent upon an understanding of the illustrative embodiments about to be described or will be indicated in the appended claims, and various advantages not referred to herein will occur to one skilled in the art upon employment of the invention in practice.

BRIEF DESCRIPTION OF THE DRAWINGS

A preferred embodiment of the invention has been chosen for purposes of illustration and description and is shown in the accompanying drawings, forming a part of the specification, wherein:

FIG. 10 is a perspective view of a container sealed with a cap in accordance with the present invention.

FIG. 11 is a vertical, sectional view of the package of FIG. 1, taken along line 11—11 of FIG. 10.

FIG. 12 is a vertical, sectional view of the closure cap of FIG. 10.

FIG. 13 is a bottom plan view of the closure cap of FIG. 10.

FIG. 14 is a sectional view, taken along line 14—14 on FIG. 12.

FIGS. 15 and 16 are enlarged, detailed, sectional views illustrating steps in the forming operation of the means of FIG. 17.

DESCRIPTION OF THE PREFERRED EMBODIMENT

This invention is an improved closure cap of the type known as a twist cap. These closure caps are formed with a shaped metal shell having a number of container engaging lugs formed at the bottom of a depending cap skirt. The containers have complementary threads or lugs formed near the container rim to engage the cap lugs. Usually, four lugs are provided on both the closure and on the container permitting a cap to be applied or removed with a rotation of 90° or less although differing number of lugs may be used. The cap shells have decorative protective coatings on their outer surfaces and protective liners or coatings on their inner surfaces. A sealing gasket is provided to form a seal between the cap and the container. A preferred and widely used gasket comprises a flowed-in plastisol ring gasket usually positioned a gasket-retaining channel positioned at the outer portion of the closure cover. Other gaskets or seals may be used such as discs covering the entire underside of the cap cover.

Such twist caps have achieved wide popularity and are used daily in enormous quantities for various food and other packaging operations.

These known caps have a cross section consisting of generally flat tops with straight downwardly depending cylindrical skirts. The cap lugs are formed on the lower edges of the cap skirts and flowed in gaskets cover at least a ring-like channel formed in cap top.

Due to the shape of the present common and preferred containers now in use, there exists a significant overhang at the outer edge of the present closure covers and in the general area of the cap corner. This particular shape requires sufficient metal to extend around the square corner and also uses sufficient gasket material to extend at least from the cap corner to the inner margin of the gasket channel.

Figure 1:
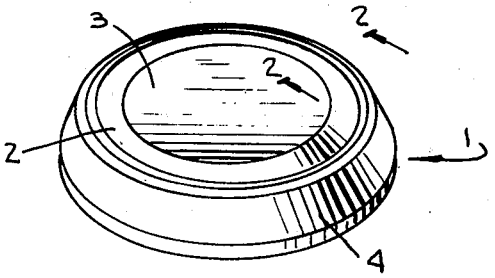
FIG. 1 is a perspective view of a closure cap in accordance with the present invention.
Figure 2:
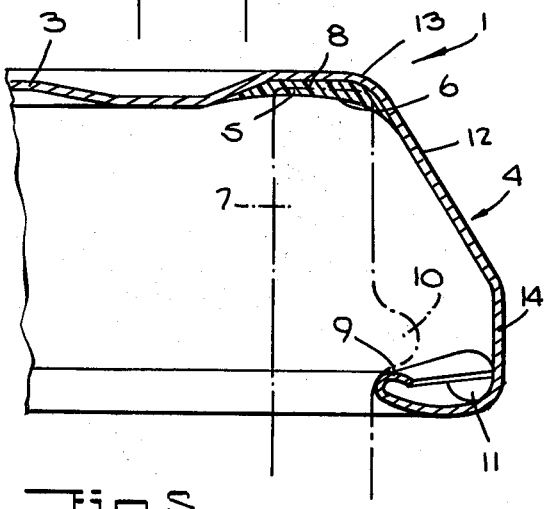
FIG. 2 is an enlarged sectional view of the cap of FIG. 14, taken along line 2—2 on FIG. 1.
Figure 3:
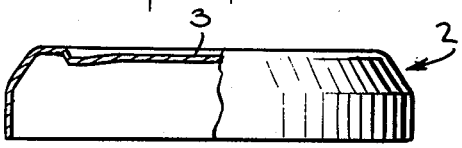
FIGS. 3 through 6 are side-elevational views, partially in section, illustrating successive lugging steps for the cap of FIG. 1.

FIGS. 1 and 2 illustrate a preferred embodiment of the cap of this invention. The cap 1 has a shell 2 formed of metal plate. The finished shell 1 has a cover 3 with a depending skirt 4. The cap seal is illustrated as a flowed in plastisol gasket 5 which occupies a downwardly facing channel 6.

The typical container is illustrated at 7 in FIG. 2 having a rim 8 in sealed engagement with the cap gasket 5. Lugs 9 on the lower edge of the cap skirt 4 engage cooperating lugs 10 on the container 7.

The cap lugs 9 extend inwardly of an inwardly rolled bead 11 formed on the lower edge of the cap skirt. A preferred and novel method of forming the lugs 9 and the bead 11 will be given below in connection with the description of FIGS. 3–9 and 18–22.

FIGS. 1 and 2 illustrate the preferred shape of the completed cap shell. The cap skirt 4 has a flared portion 12 extending downwardly and outwardly from a position at the corner 13 above the outer edge of the container rim 8. The flared portion 12 merges with a slight curve or radius 13 into a generally vertical lower skirt portion 14 which in turn merges at its bottom into the inwardly curled bead 11. The radius of the generally cylindrical lower skirt portion 14 is determined by the radial length of the cap lug 9. The lugs 9 extend radially inwardly for a distance greater than that of the depth of the closure lugs 10 so that they have some flexibility to facilitate the sealing of the containers as well as seal retention during the package shipment and storage.

The above described outer portion and skirt of the cap combine to form a rigid channel-like configuration which has the inherent rigidity of a channel member. This characteristic together with the tapered corner provide for an increased damage resistance. Accordingly, caps with this shaping may be formed from a lighter weight metal plate than those of the prior square cornered shape regardless of the particular metal used. For example, where a cap shell previously required a 75 pound plate, a 55 or 60 pound plate has been found fully satisfactory. Thus, an approximately 20 to 25% saving in metal is obtained. Since the flowed in gasket material is extended outwardly to the skirt for sealing and application purposes, the lesser cap top diameter also results in a saving of 30 to 50% of the plastisol sealing compound for the gasket 5. The use of the lighter weight metal also retains a necessary degree of flexing ability in the cap skirt for accepting variations in closure to glass tolerance and sealing application torque.

The more or less conventional blanking and shaping dies as used to form the square cornered cap shells of present twist type closures have been found to be unsatisfactory for forming the improved closure shell of this invention. In particular, the flared skirt portion 12 when drawn away from the plane of the cover portion 3 in conventional drawing tools is wrinkled to an unacceptable degree.

Figure 7:
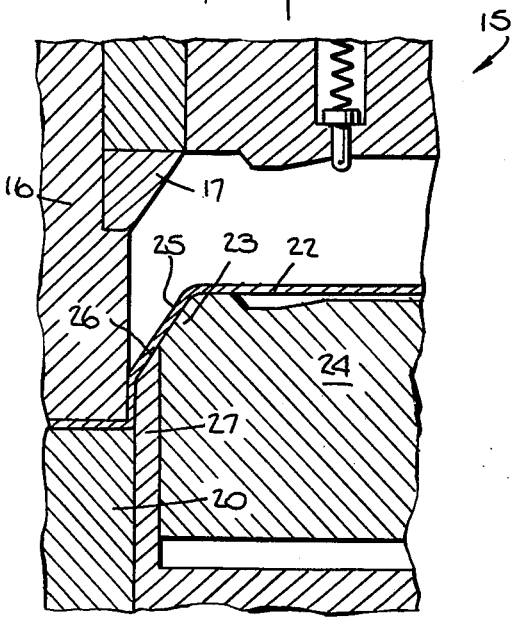
FIGS. 7 and 8 are enlarged vertical sectional views, illustrating successive operating steps of the shell forming means of FIG. 9.
Figure 8:
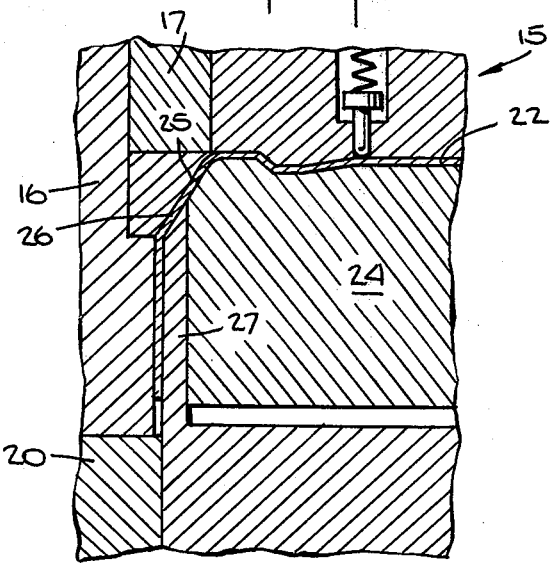
Figure 9:
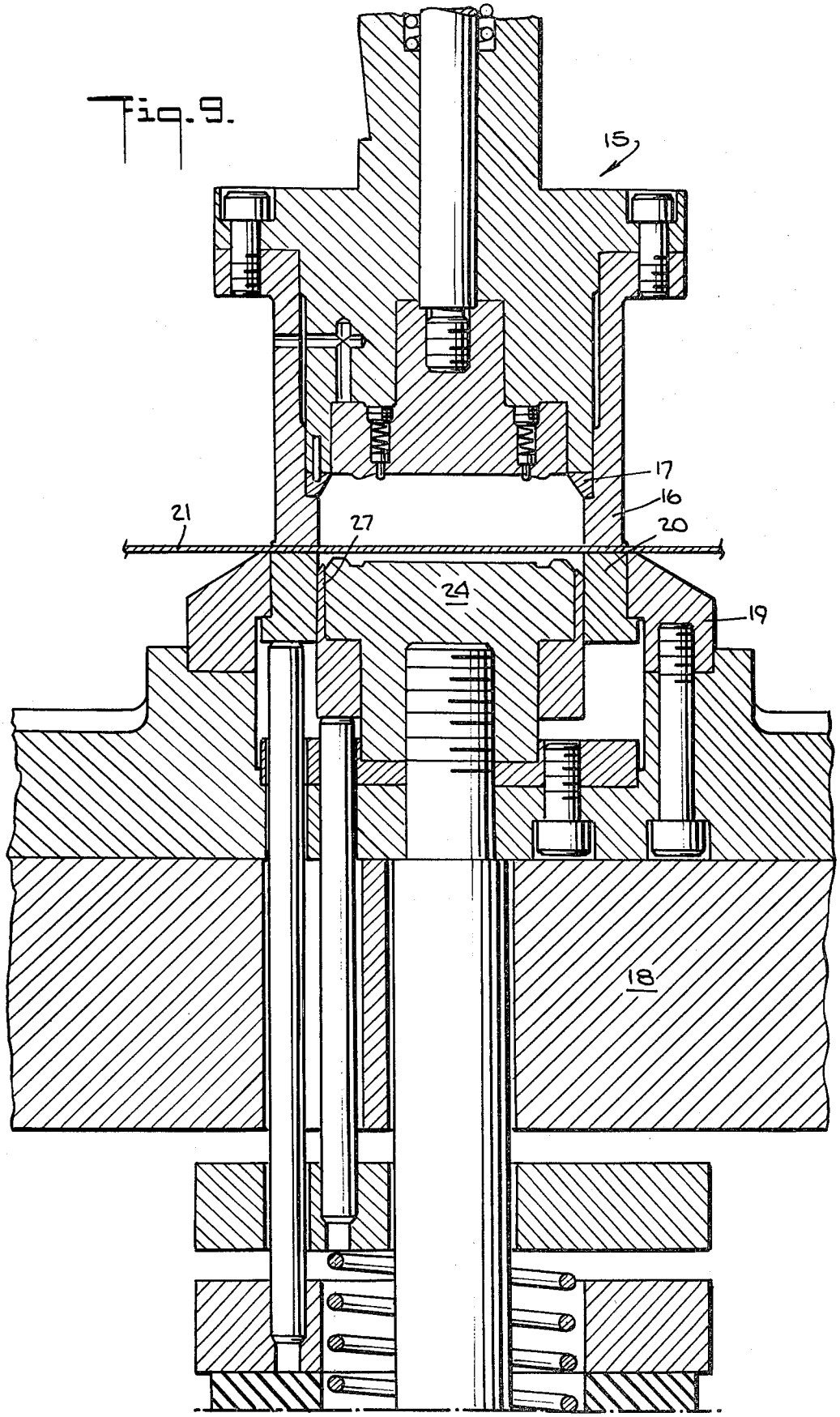
FIG. 9 is a vertical sectional view of a preferred embodiment of a shell forming means in accordance with the invention.

A novel preferred tool means which eliminates this drawback is illustrated in FIGS. 7–9.

FIG. 9 illustrates a head for blanking and drawing a cap shell from metal plate. The reciprocally driven upper head 15 includes a blanking ring 16 and a shaping die 17. A fixedly positioned bolster plate 18 mounts a stationary cutting ring 19 and a spring loaded lower blanking ring 20.

When the upper head is driven downwardly against a sheet of metal plate 21, the cooperating blanking rings 16 and 20 and cutting ring 19 blank a circular blank 22 from the plate 21. The blank 22 is drawn downwardly by the rings 16 and 20 with its margin being pulled around the corner 23 on lower shaping die or plug 24 (FIG. 7). Further downward movement of rings 16 and 20 draws the outer portion of the blank 22 against the flared portion 25 of the die 24 and against a correspondingly flared surface 26 on a resiliently mounted ring die 27. The supporting force of the downwardly forced ring die 27 causes the flared portion 12 of the blank 22 to have a smooth unwrinkled shaping.

In the final position of the shaping tools, as illustrated in FIG. 8, the skirt portion of the shaped shell has the flared portion 12 and an elongated lower skirt portion 14 as illustrated in FIG. 2.

Figure 5:
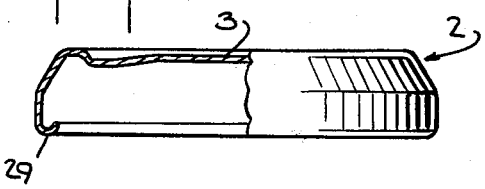
Figure 4:
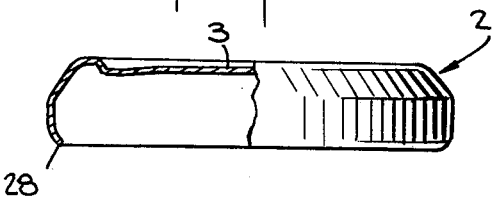
Figure 6:
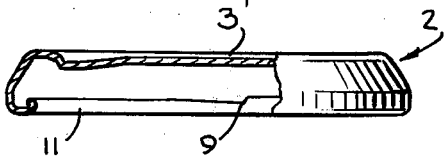

The next steps in the cap shell formation are the curling and lugging steps. FIGS. 4 and 5 illustrate successive curling steps on the shell 2 for creating the bead 11. FIG. 6 shows the final curling and the lugs 9 formed at spaced intervals around the wire or bead 11.

FIGS. 18–22 illustrate an improved curling and lugging means for use with the closure cap of the invention.

Figure 18:
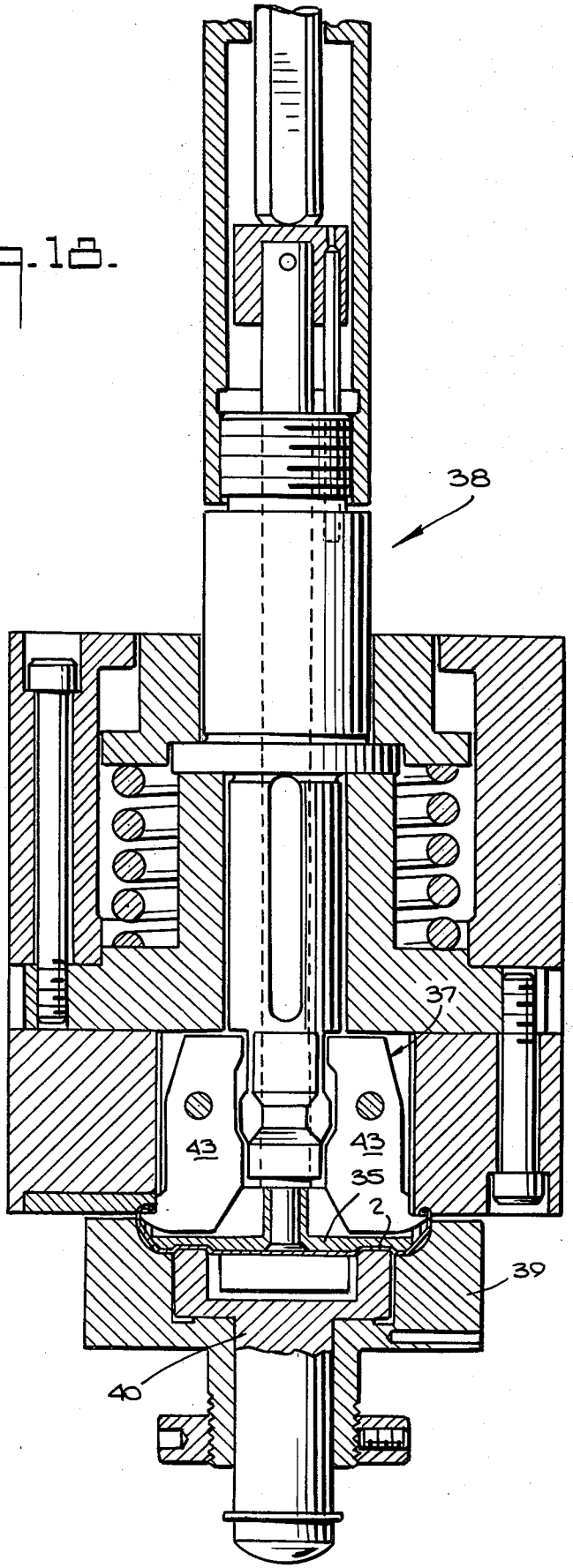
FIG. 18 is a vertical sectional view of a lugging means in accordance with the invention.
Figure 19:
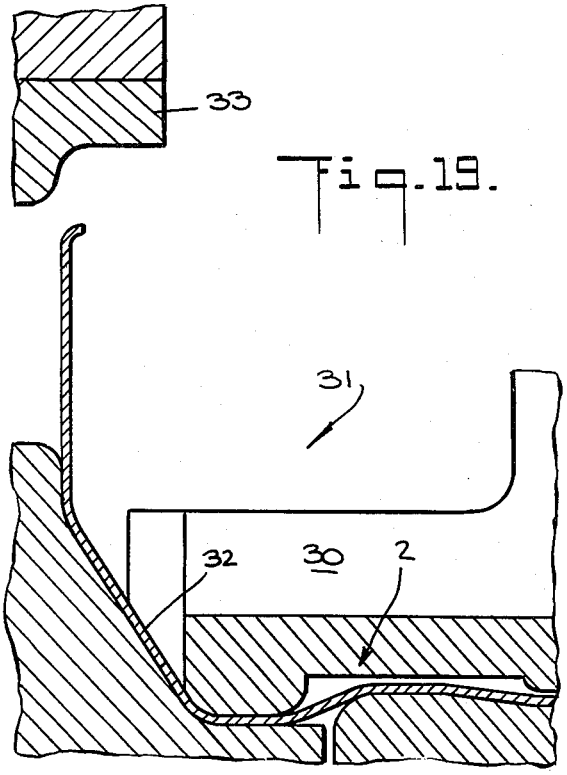
FIGS. 19 through 22 are enlarged, detailed, sectional views, illustrating successive steps in the operation of the lugging means of FIG. 18.
Figure 21:
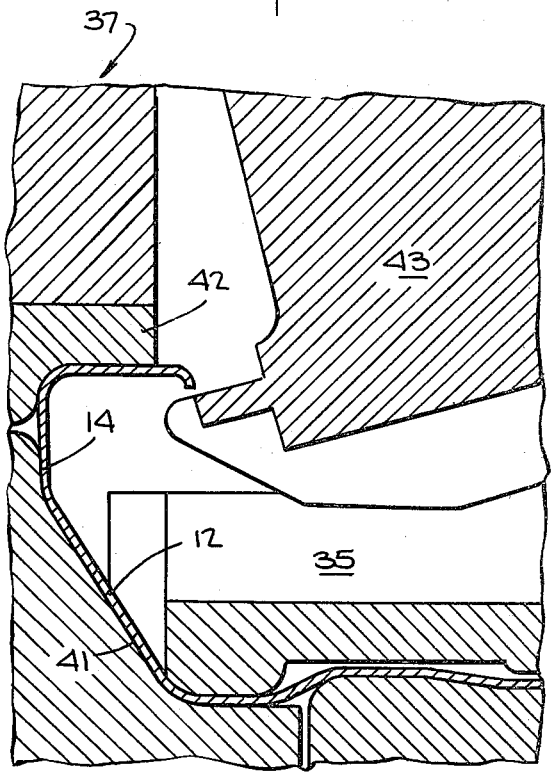
Figure 20:
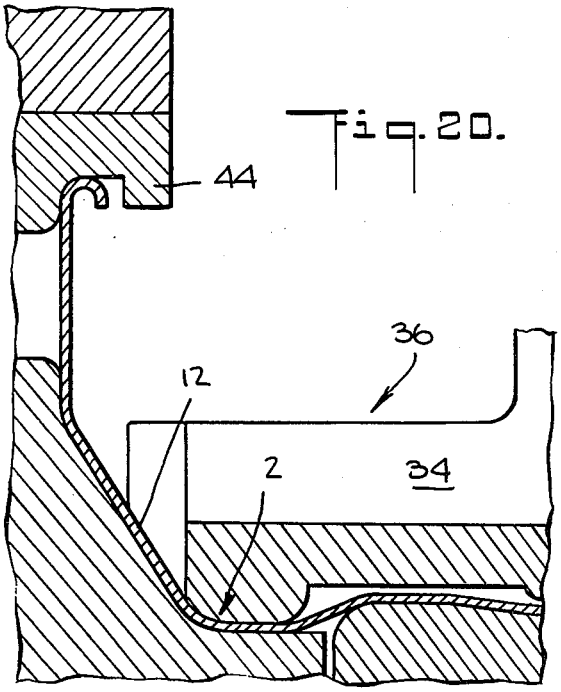
Figure 22:
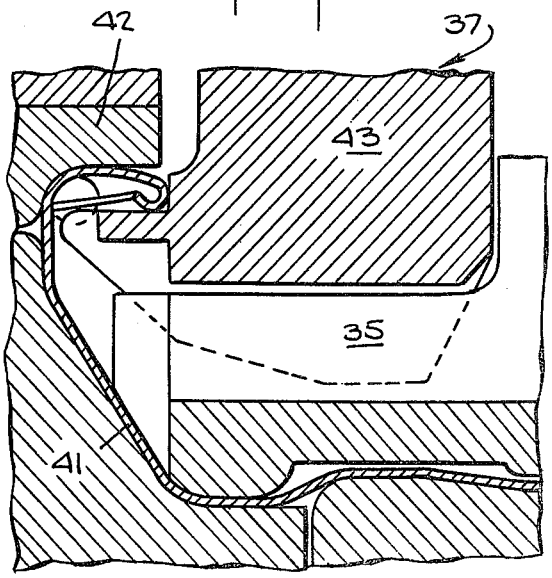

In the curling and lugging operations of this invention the inverted cap shells are presented to a series of tools such as the tool 21 of FIG. 19 to perform the precurl 28 of FIG. 4, the tool 36 of FIG. 20 to perform the first curl 29 of FIG. 5 and the tool 37 of FIGS. 18, 21 and 22 to perform the final curl and lugging. These tools differ from prior tools due to differing shape of the closure cap skirt. The straight skirts of prior twist caps are curled and lugged by direct downward force without undesired deformation or collapse. These present tools are not satisfactory for the cap of this invention as the tapered skirt shape tends to collapse under downward shaping tool force.

The improved tools illustrated in FIGS. 18–22 overcome this problem and provide effective high speed curling and lugging steps.

A hold down pad 30 (FIG. 19) is positional in the precurling tool 31 having flared outer surfaces 32 shaped to rightly engage and to hold the skirt 4 against any undesired buckling or collapse in the flared and lower portions 12 and 14. The precurling ring 33 of the otherwise regular precurling tool 31 performs the usual precurling operation.

Similarly hold down pads 34 and 35 are used for the first curling tool 36 FIG. 20 with curling ring 44 and the second curling and lugging tool 37 FIGS. 18 and 22.

FIG. 18 illustrates the second curling and lugging tool 37 where relative motion is provided to bring the curling and lugging head 38 into engagement with a cap shell 2 in a nest 39 having shell ejector 40. The resiliently mounted or loaded hold down pad 35 with the flared support surface 41 hold the shell 2 tightly in place during the operation of the otherwise conventional second curling ring 42 and the lugging jaws 43. This lugging and curling means and its method of operation, as described and illustrated, provides an improved means particularly useful for the new cap described herein.

FIGS. 10–14 illustrate another embodiment of the improved twist cap of the invention. The closure cap 50 has a shell 51 with a skirt 52 and cover 53 generally similar to that of the closure cap 1 including lugs 54 and sealing gasket 55. The flared portion 56 of the skirt 52 differs from that of cap 1 by including a series of spaced corrugations or indents 57. The preferred indentations 57, as illustrated in FIGS. 10–14, comprise concave indentations of generally oval outline. The indentations by their corrugating action stiffen the upper skirt thereby permitting a substantial reduction of the metal plate weight for the cap shells and further reinforce the skirt stiffening action already described for the closure cap 1 of FIGS. 1 and 2. The preferred shape of the flared portion is the arcuate or convex curve as best illustrated in FIGS. 11 and 12. Other forms of corrugations or indentations may be used to obtain the improved results discussed above.

Figure 17:
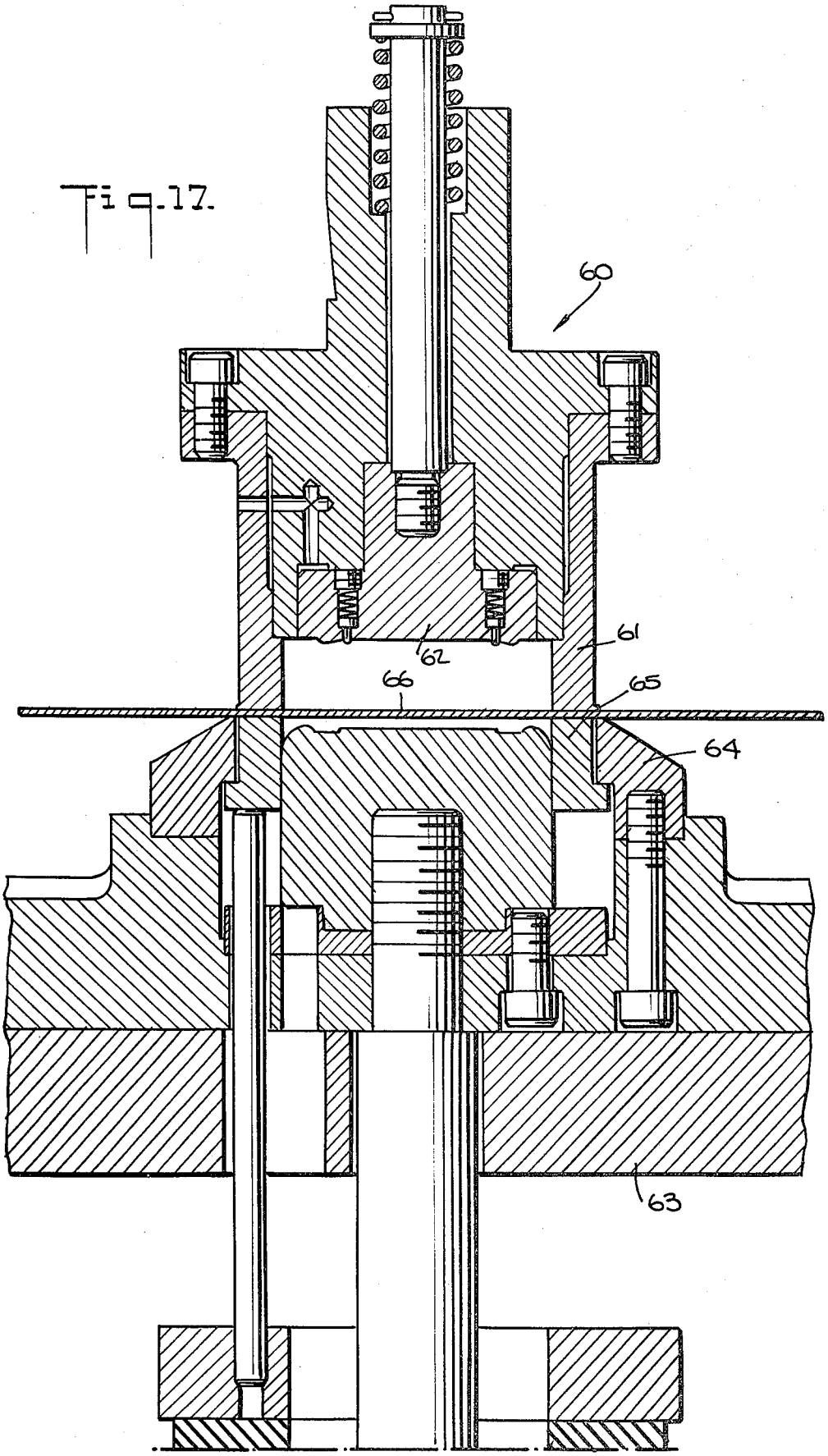
FIG. 17 is a vertical sectional view of a cap shell forming means.

While the tools of FIGS. 7–9 may be used for the cap of FIG. 10 with dies having suitable cut-outs for the indents, the presence of the indentations permits the use of novel but somewhat simpler tools as illustrated in FIGS. 15–17.

FIG. 17 illustrates a head for blanking and drawing a cap shell 51 from metal plate. The reciprocally driven upper head 60 includes a blanking ring 61 and a shaping die 62. A fixedly positioned bolster plate 63 mounts a stationary cutting ring 64 and a spring loaded lower blanking ring 65.

When the upper head 60 is driven downwardly against a sheet of metal plate 66, the cooperating blanking rings 61 and 65 and cutting ring 64 blank a circular blank 66 (FIG. 15) from the plate 66. The blank 59 is drawn downwardly by the rings 61 and 65 with its margin being pulled around the corner 67 on a lower shaping die or plug 68 (FIG. 15). Further downward movement of rings 61 and 65 draws the outer portion of the blank against die 68 while the upper die 69 complete the shaping of the cap shell cover 53.

It will be seen that an improved closure cap of the twist style has been disclosed which provides an effective seal on existing containers while at the same time saving cap metal, gasket material, and packaging. The cap, by using lighter metal also provides a saving in shipping weights and expenses. Improved means for forming the embodiments of the new cap are also described which permit their manufacture by modified forms of conventional high speed closure making machinery.

As various changes may be made in the form, construction and arrangement of the parts herein without sacrificing any of its advantages, it is to be understood that all matter herein is to be interpreted as illustrative and not in a limiting sense.

Having thus described my invention, I claim:

1. In a closure cap having a metal shell with a cover and a depending skirt and having a flowed-in plastisol sealing gasket and inwardly projecting lugs formed on the bottom of the skirt for engaging lugs on a container the improvement comprising said cap skirt having a tapered upper portion extending downwardly and outwardly to the top of a generally cylindrical lower skirt portion, said sealing gasket being positioned in a downwardly facing channel extending radially outwardly to the top of said tapered skirt portion and said tapered upper portion having a radial dimension approximately equal to the radial width of the cap lugs and a vertical dimension greater than half the skirt height.

2. The closure cap as claimed in claim 1 in which said container lugs have a radial width of approximately one-half that of said closure lugs.

3. The closure cap as claimed in claim 1 in which said tapered upper skirt portion is straight.

4. The closure cap as claimed in claim 1 in which said tapered upper portion is arcuate.

5. The closure cap as claimed in claim 4 in which the upper skirt portion includes indentations.

6. The closure cap as claimed in claim 1 in which said upper skirt portion includes indentations.

7. The closure cap as claimed in claim 6 in which said indentations are closely and regularly spaced.

8. A sealed package comprising the combination of a closure cap and a container where said container has a plurality of projecting lugs extending outwardly from a generally cylindrical rim portion and where said closure cap has a cover with a sealing gasket on its under surface and a depending skirt with inwardly projecting lugs on the skirt bottom engaging said container lugs the improvement comprising an improved cap skirt having a downwardly flaring upper skirt portion terminating in a generally cylindrical lower skirt portion, said upper flaring portion extending downwardly and outwardly from a position above the outer edge of said container rim portion to a position outwardly of said container lugs, said sealing gasket being positioned in a downwardly facing channel extending radially outwardly to the top of said tapered skirt portion and said tapered upper portion having a radial dimension approximately equal to the radial width of the cap lugs and a vertical dimension greater than half the skirt height.

9. The package as claimed in claim 8 in which said container lugs have a radial width of approximately one-half that of said closure lugs.

10. The package as claimed in claim 8 in which said tapered upper skirt portion is straight.

11. The package as claimed in claim 8 in which said tapered upper portion is arcuate.

12. The package as claimed in claim 11 in which the upper skirt portion includes indentations.

13. The package as claimed in claim 8 in which said upper skirt portion includes indentations.

14. The package as claimed in claim 13 in which said indentations are closely and regularly spaced.

* * * * *

REEXAMINATION CERTIFICATE (1445th)

United States Patent [19]

Ochs

[11] B1 4,392,580

[45] Certificate Issued Apr. 2, 1991

[54] CLOSURE CAP

[75] Inventor: Charles S. Ochs, Lancaster, Ohio

[73] Assignee: Anchor Hocking Corp., Lancaster, Ohio

Reexamination Request:
No. 90/001,836, Aug. 31, 1989

Reexamination Certificate for:

| | |
|---|---|
| Patent No.: | **4,392,580** |
| Issued: | **Jul. 12, 1983** |
| Appl. No.: | **285,610** |
| Filed: | **Jul. 21, 1981** |

[51] Int. Cl.[5] ..... B65D 41/04

[52] U.S. Cl. ..... 215/332; 215/333; 215/353

[58] Field of Search ..... 215/329-339

[56] References Cited

U.S. PATENT DOCUMENTS

| | | | |
|---|---|---|---|
| D. 192,757 | 5/1962 | Foss et al. | D58/26 |
| D. 212,843 | 12/1968 | Hart et al. | D9/267 |
| 819,236 | 5/1906 | Lorenz . | |
| 1,300,252 | 4/1919 | Doldt . | |
| 1,365,274 | 1/1921 | Rivers . | |
| 1,667,003 | 4/1928 | Hardiman | 215/333 |
| 2,445,647 | 7/1948 | Thomas . | |
| 2,463,701 | 3/1949 | Krueger . | |
| 2,957,595 | 10/1960 | White et al. . | |
| 3,110,409 | 11/1963 | Chaplin . | |
| 3,143,234 | 8/1964 | Foss et al. . | |
| 3,155,261 | 11/1964 | Acton et al. . | |
| 3,270,904 | 9/1966 | Foster et al. . | |
| 3,323,672 | 6/1967 | Acton | 215/333 |
| 3,469,727 | 9/1969 | Acton | 215/333 X |
| 3,494,497 | 2/1970 | Vercillo . | |
| 3,516,565 | 6/1970 | Hatkevich | 215/333 |
| 4,227,616 | 10/1980 | Lecinski | 215/246 |

FOREIGN PATENT DOCUMENTS

| | | |
|---|---|---|
| 1503040 | 3/1978 | United Kingdom . |

OTHER PUBLICATIONS

Documents relating to "DSR" cap made by White Cap Company, 9/1979.

1978-1979 "FEM/Chilton's Food Engineering Master", p. 126 and second page.

*Primary Examiner*—Stephen Marcus

[57] ABSTRACT

A metal closure cap is described for sealing containers. It is of the lug type having a metal shell with a flowed-in gasket. The cap differs from prior twist caps of this general type by having a tapered corner between the cap top and the cap skirt. This corner design permits a reduced amount of metal to be used and further provides a more rigid closure corner permitting the use of lighter-weight metal. Improved methods of forming the cap shell, including the corner portion are also described.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–13 and 14 are cancelled.

* * * * *